United States Patent [19]

Allen et al.

[11] 4,353,413

[45] Oct. 12, 1982

[54] RENDERING DRYER

[75] Inventors: William M. Allen; Gordon C. Trabue, both of Louisville, Ky.

[73] Assignee: Chemetron Process Equipment, Inc., Louisville, Ky.

[21] Appl. No.: 184,710

[22] Filed: Sep. 8, 1980

[51] Int. Cl.[3] ..... F28D 11/04

[52] U.S. Cl. ..... 165/92; 34/183; 165/93

[58] Field of Search ..... 165/92, 93, 91, 94; 34/179, 183

[56] References Cited

U.S. PATENT DOCUMENTS

| | | | |
|---|---|---|---|
| 769,557 | 9/1904 | von May | 165/92 |
| 1,951,996 | 3/1934 | Schaeter | 165/92 |
| 3,769,900 | 11/1973 | Onarheim et al. | 165/92 X |
| 3,777,810 | 12/1973 | Phillips | 165/92 |
| 3,800,865 | 4/1974 | Onarheim et al. | 165/92 |
| 4,074,751 | 2/1978 | Ducasse | 165/92 |
| 4,301,860 | 11/1981 | Pozzi | 165/92 X |

FOREIGN PATENT DOCUMENTS

| | | | |
|---|---|---|---|
| 2260820 | 6/1973 | Fed. Rep. of Germany | 165/92 |
| 120671 | 11/1970 | Norway | 165/92 |
| 952099 | 3/1964 | United Kingdom | 165/92 |

*Primary Examiner*—Sheldon J. Richter

*Attorney, Agent, or Firm*—John K. Williamson

[57] ABSTRACT

A dryer is provided with interacting heat transfer stator and rotor for improved processing capability. The stator comprises a stationary row of planar heat exchange banks supported within the vessel of the dryer. The rotor has a complemental number of annular heat exchange vanes interleaved between the heat exchange banks of the stator to create desired low-level agitation of the processed material as the rotor turns and to provide increased heat transfer efficiency. The vanes on the rotor and the banks of the stator each comprise an open grillwork of tubular members whereby the processed material may flow freely through the vanes and banks for additionally increased heat transfer efficiency and reduced residence time for the material.

11 Claims, 7 Drawing Figures

RENDERING DRYER

TECHNICAL FIELD

This invention relates to heat exchangers in general, and particularly concerns a rotary dryer for removing moisture from hydrous animal material or the like, as in a rendering operation.

BACKGROUND ART

Rotary dryers have long been used in the dry rendering of animal fats and similar material. One such dryer is shown in U.S. Pat. No. 3,800,865 issued to Onarheim et al., and entitled "Heat Exchangers". The Onarheim dryer comprises a sealable cooking vessel having a multivaned heat transfer rotor centrally mounted therewithin. Powered rotation of the rotor during the rendering operation serves to agitate the material contained in the vessel for improved heat transfer efficiency from the rotor.

Another dryer suitable for dry rendering is disclosed in U.S. Pat. No. 3,777,810, issued to Phillips and entitled "Dryer". In the Phillips dryer, the disc-like annular vanes on the heat transfer rotor are each comprised of concentric, interconnected, toroidal chambers. The particular shape of the vanes in the Phillips dryer allows thin-wall construction of the vanes for improved heat transfer to the material in the vessel. Another rotary dryer, disclosed in Onarheim, U.S. Pat. No. 3,769,900, includes a jacketed vessel for additional heat transfer in cooperation with the heat transfer rotor.

Though the aforementioned dryers are suited for conventional dry rendering operations, they are not particularly heat efficient, they require a relatively long residence time which may be detrimental to the resultant protein products, and the ones of them which are capable of processing at high rates (more than 10,000 pounds per hour) require a substantial amount of floor space.

SUMMARY OF THE INVENTION

The present invention concerns a highly efficient, compact, rotary dryer, capable of rendering large amounts of animal material with reduced energy consumption and a short material residence time.

A series of annular vanes on the heat exchange rotor of the present invention each comprise a grillwork of concentric, radially spaced toroidal tubular members such that processed material may pass through the vanes longitudinally of the vessel for improved heat transfer. The grillwork construction also provides substantially greater heat transfer surface than in the vanes of rotary dryers heretofore available.

Additionally, the dryer of the present invention is provided with a heat transfer stator secured to the vessel in interacting relationship with the rotor. The stator comprises a row of stationary heat exchange banks each interleaved between a pair of adjacent vanes on the rotor. Like the heat transfer vanes, the banks are a grill-like assembly of tubular members to permit the passage of processed material therethrough.

Heat transfer fluid is circulated through the stator and rotor during operation of the dryer, and a drive is provided for power rotation of the rotor. In preferred forms, the toroidal tubes of the rotor vanes are acircular such that there is relative radial movement between the vanes and the stator banks to increase heat transfer efficiency.

The stator banks themselves are generally U-shaped with a lowermost bight and a pair of opposed upright legs adjacent respective sidewalls of the dryer vessel. This unique construction of the stator banks, together with the arrangement of the rotor, permits the rotor vanes to move through the processed material in a desired manner without creating mass rotation within the vessel and resultant loss of heat transfer efficiency.

DETAILED DESCRIPTION OF THE DRAWINGS

Figure 1:
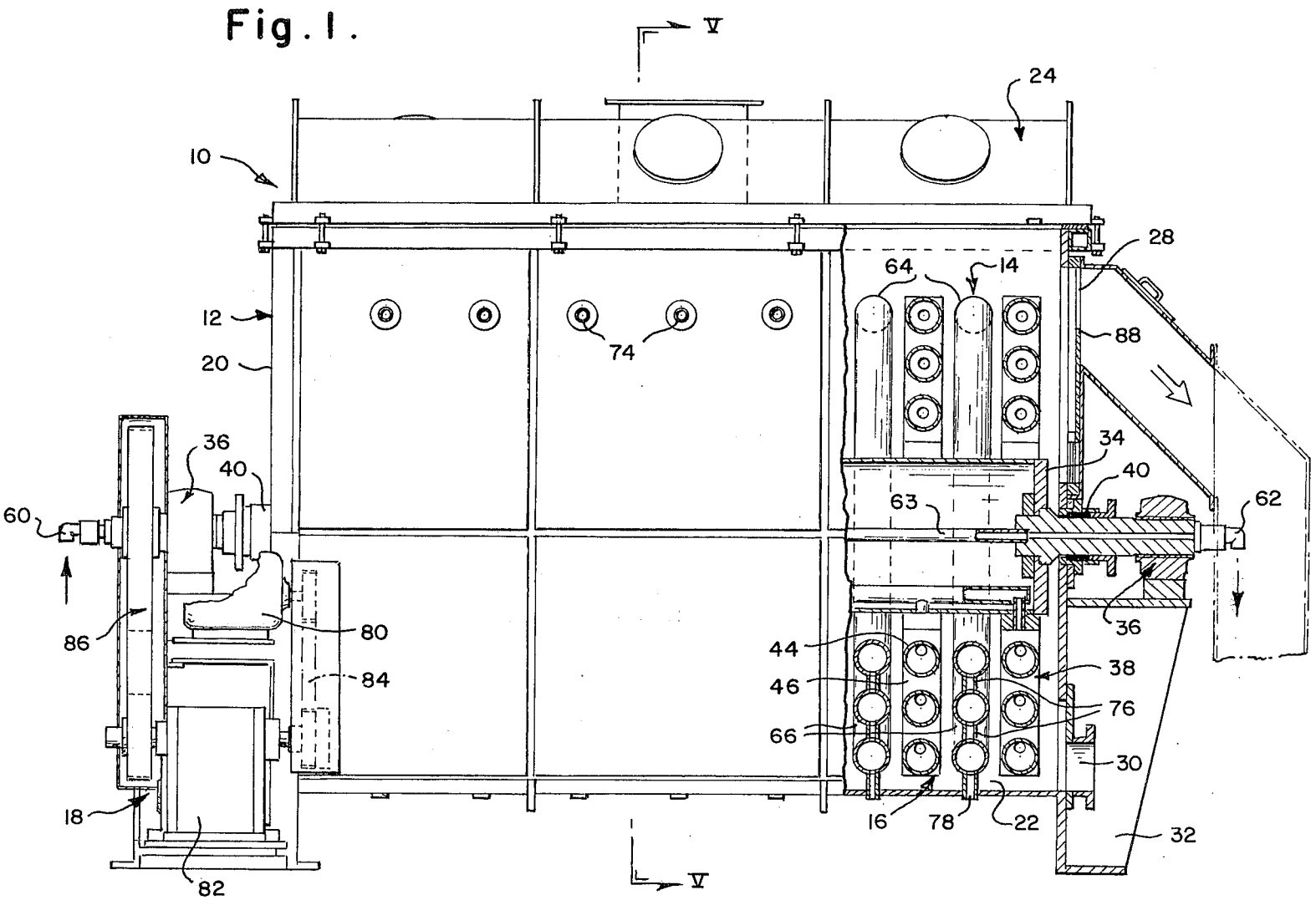
FIG. 1 is a side elevation view of a dryer constructed in accordance with the principles of the present invention and having portions thereof broken away to reveal details of construction.
Figure 2:
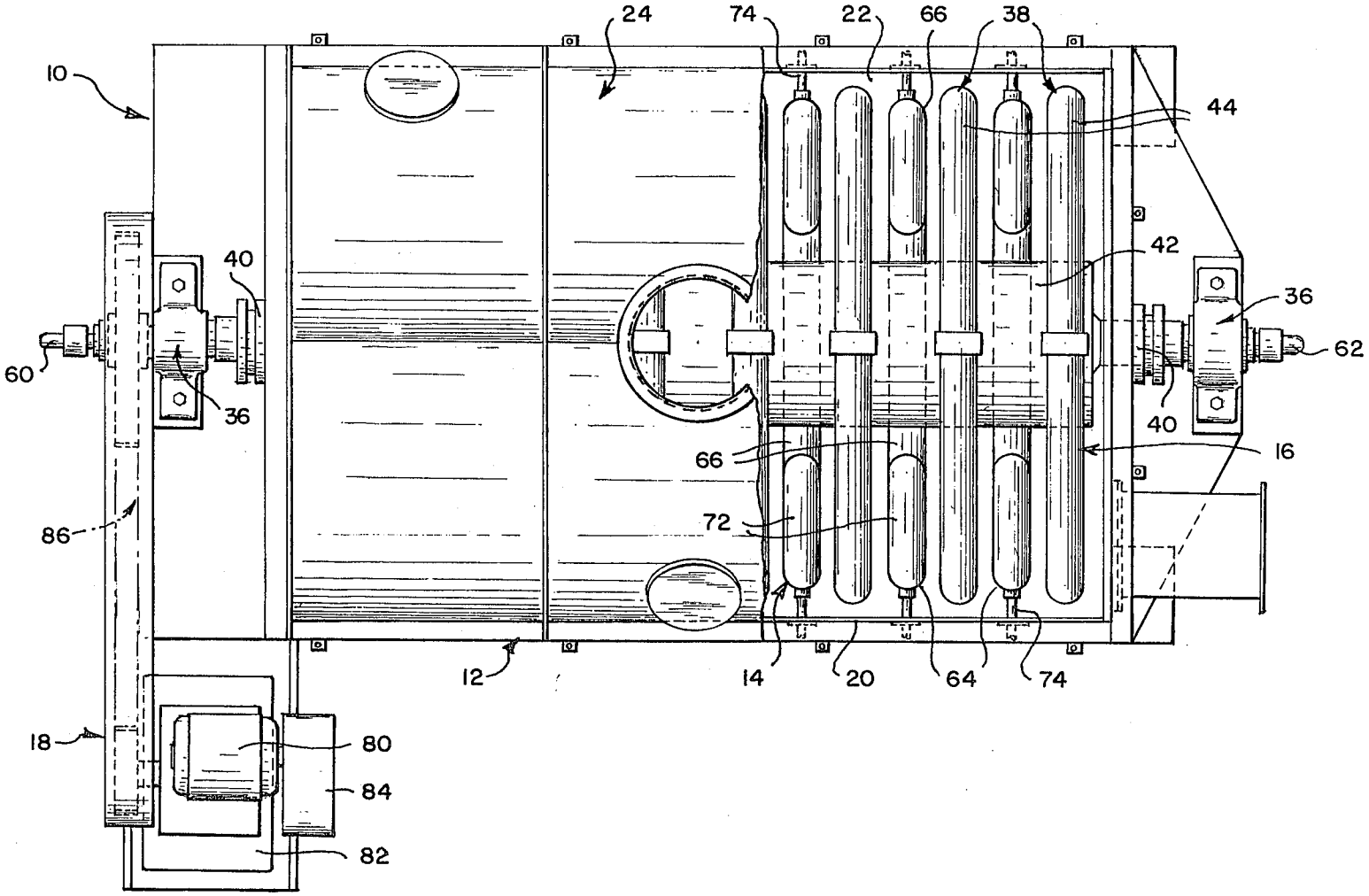
FIG. 2 is a top plan view of the dryer with a portion of the cover removed.
Figure 3:
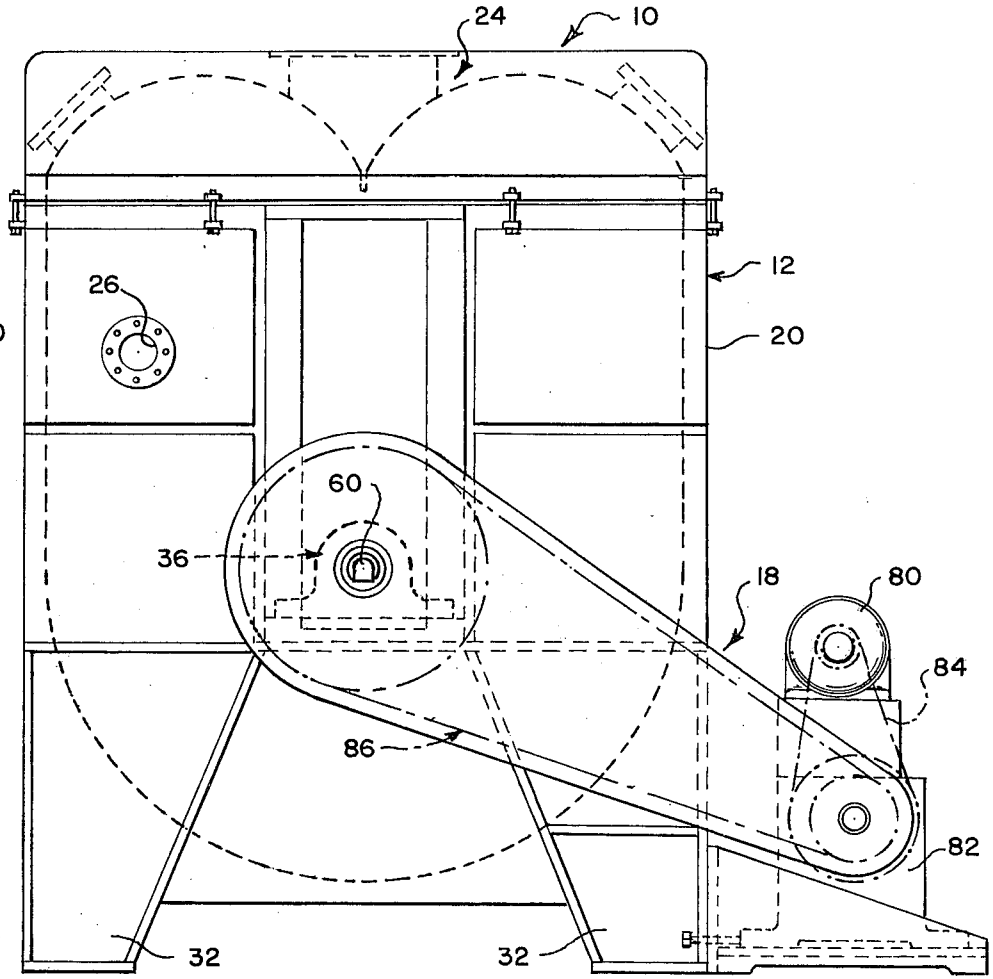
FIG. 3 is an end elevational view of the dryer as viewed from the left of FIG. 1.
Figure 4:
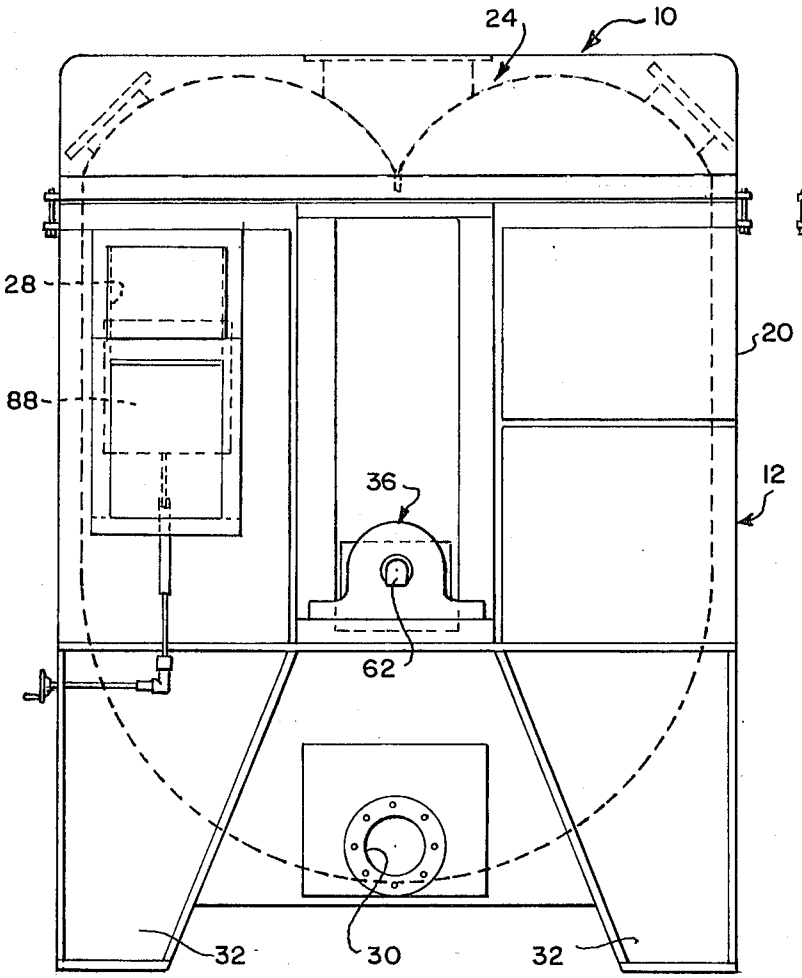
FIG. 4 is an end elevational view as viewed from the right of FIG. 1.

In FIG. 1, there is shown a rotary dryer 10 comprising an elongate, horizontally extending vessel 12, a stationary heat exchange stator 14 mounted within the vessel 12, and an elongate, heat exchange rotor 16 rotably supported within the vessel 12 in interacting relation to the stator 14. Both the stator 14 and the rotor 16 are adapted to be coupled with a source of steam (not shown) or other heat transfer fluid in a manner to be described, for controlled heating of material in the vessel 12. A power drive 18 is mechanically coupled to the rotor 16 for powered rotation thereof during operation of the dryer 10. The dryer 10 is intended for use in the rendering of animal carcasses after passage through a pre-breaker (not shown) but may be utilized to dry a wide variety of materials in slurry form.

The vessel 12 includes a generally rectangular hollow lower section 20 defining an interior material-receiving chamber 22, and a shallow top section 24 removably secured to the lower section 20 to permit selective enclosing of the chamber 22. A product inlet 26 extends through one endwall of the section 20 and there is provided a product outlet 28 in the opposite endwall thereof. Additionally, there is formed a drain 30 adjacent the bottom of the lower section 20 in the same endwall as the product outlet 28. In preferred forms, the vessel 12 is provided with floor-engaging legs 32 for elevating the section 20 above the floor on which the dryer is supported.

The rotor 16 comprises an elongate hollow shaft 34 journalled to the lower section 20 by a pair of bearings 36 mounted on opposite endwalls thereof exterior of the chamber 22, and a series of annular heat exchange vanes 38 secured to the shaft 34 in spaced relation along the axis thereof. Seals 40 are provided for the shaft 34 at opposite endwalls of the lower section 20 to preclude leakage of material from the chamber 22.

Figure 7:
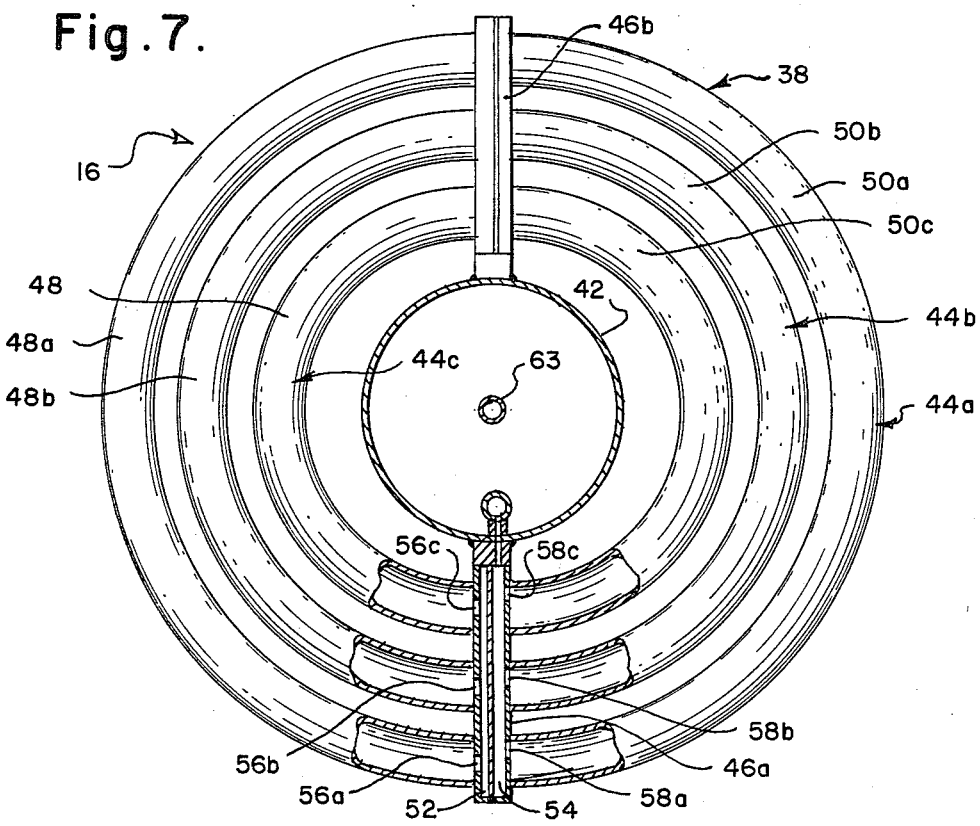
FIG. 7 is an elevational view of the rotor shown partly in section.

Considering now FIGS. 1 and 7 which illustrate the rotor 16 in further detail, it may be seen that the shaft 34 has an enlarged, hollow, cylindrical drum 42 which extends the full length of the series of vanes 38 and provides the structure upon which the vanes 38 are supported. As shown in FIG. 7, each vane 38 comprises an open grillwork formed of three concentric, progressively sized, toroidal tubes 44*a*, 44*b* and 44*c*. The tubes 44 of each vane 38 are supported coaxially of the shaft 34, in a plane extending perpendicularly thereof, by a pair of opposed, tubular spokes 46*a* and 46*b* projecting radially from the drum 42 and communicating with the interior of the shaft 34. Each toroidal tube 44 comprises a pair of 180° arcuate members 48 and 50 extending between the spokes 46*a* and 46*b* as shown for example in FIG. 7.

The spokes 46 are longitudinally divided to form a steam delivery conduit 52 communicating directly with the interior of the drum 42 and a condensate return conduit 54 communicating with a condensate header (not shown) within the shaft 34. The delivery conduit 52 of the spoke 46*a* is in flow communication with one end of the arcuate members 48*a, b,* and *c,* via the respective apertures 56*a, b* and *c*. The opposite end of the members 48*a, b* and *c* is in flow communication with the condensate return conduit 54 of the spoke 46*b* via ports 58*a, b,* and *c,* respectively. Similarly, the delivery conduit 52 of spoke 46*b* is in flow communication with one end of the arcuate members 50*a, b,* and *c,* respectively, via the apertures 56*a, b,* and *c;* and the return conduit 54 of the spoke 46*a* is in flow communication with the opposite end of the arcuate members 50*a, b,* and *c,* respectively via ports 58*a, b* and *c*. Thus, when the interior of the drum 42 is charged with steam as will be explained herein below, a steam flow is created through the vanes 38 via the steam delivery conduit 52 of the spoke 46*a,* the apertures 56*a, b* and *c,* the arcuate members 48*a, b* and *c,* the ports 58*a, b* and *c,* and the condensate return conduit 54 of the spoke 46*b;* and via the steam delivery conduit 52 of the spoke 46*b,* the apertures 56*a, b* and *c,* the arcuate members 50*a, b* and *c,* the ports 58*a, b* and *c,* and the condensate return conduit 54 of the spoke 46*a*. This bifurcated flow through the vanes 38 assures maximum heat transfer along the diameter of the tubes 44*a, b* and *c*.

Figure 5:
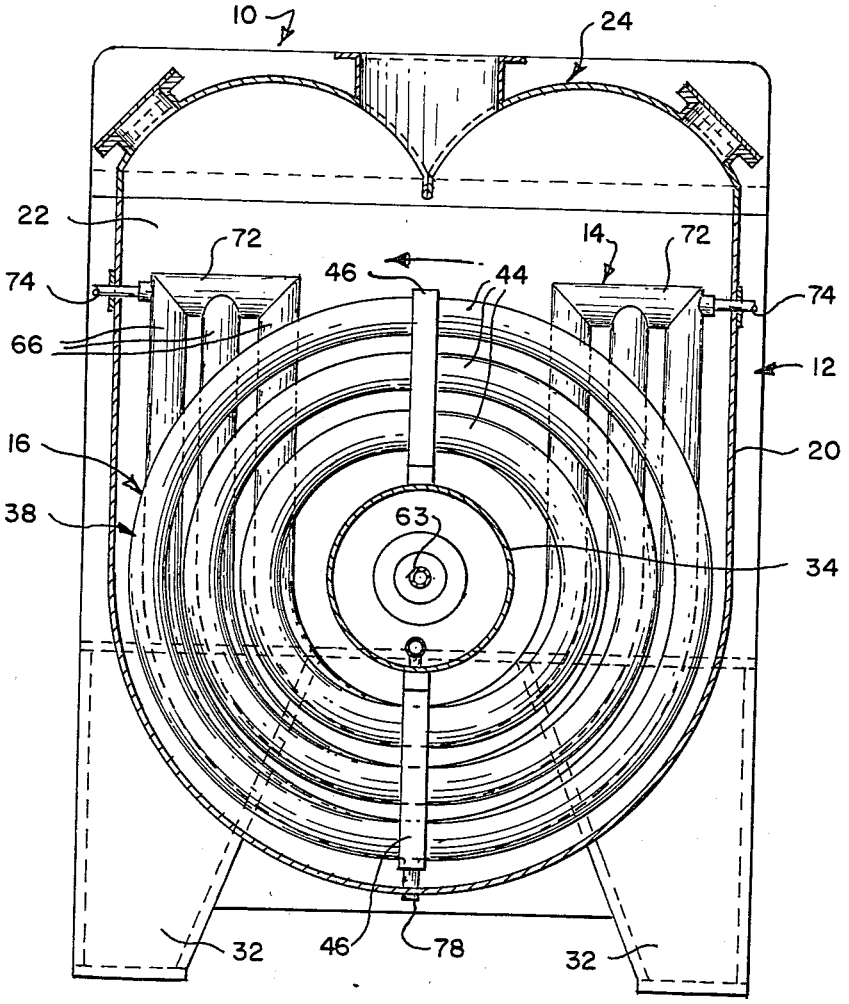
FIG. 5 is a transverse cross-sectional view taken along line V—V of FIG. 1.

Though the tubes 44*a, b* and *c* are generally toroidal in configuration, they are preferably acircular so as to create relative radial movement between the tubes 44 and the stator 14 when the rotor 16 is driven. As shown in FIG. 5, tubes 44 are complementally configured with respect to one another, with the degree of acircularity of the tubes being substantially uniform.

Considering again FIG. 1, there is shown a steam inlet 60 in flow communication with the interior of the drum 42, and adapted to be attached to the source of steam mentioned hereinabove. At the opposite end of the dryer 10 there is provided a condensate outlet 62 which is in flow communication with a central condensate header 63 within the shaft 34 to permit withdrawal of spent steam from the heat exchange rotor 16.

Considering now FIG . 3, there is shown the spaced arrangement of the vanes 38 along the length of the rotor 16. Also shown there is a stationary row of heat transfer banks 64 interleaved between the vanes 38 of the rotor 16; collectively the banks 64 form the stationary heat exchange stator 14. In the arrangement shown, there is one less bank 64 than vane 38 such that each bank 64 is disposed between a respective pair of vanes 38.

Figure 6:
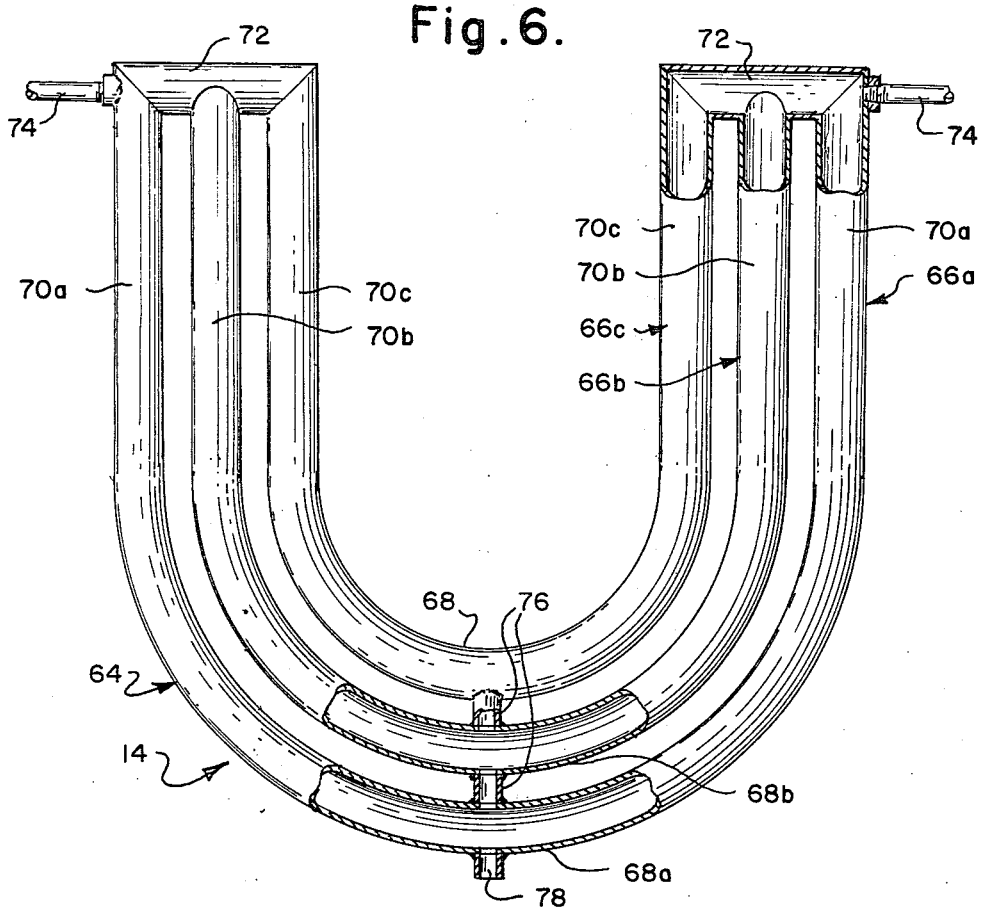
FIG. 6 is an elevational view of the stator shown partly in section.

As shown in FIG. 6, each bank 64 comprises a grillwork of complementally configured, progressively sized, U-shaped tubes 66*a, b* and *c* with each tube presenting an arcuate bight 68 and a pair of opposed upstanding legs 70. Crosspipes 72 interconnect the respective legs 70 of each U-shaped tube 66 on opposite sides of the bights 68. Each crosspipe 72 is provided with a steam inlet 74 adapted to be coupled with a source of steam (not shown). The U-shaped tubes 66 are also interconnected at their bights 68 via drain tubes 76 as shown in FIG. 6. Additionally, the bight 68*a* of the tube 66*a* is provided with a condensate outlet 78 adapted to be connected to a condensate header (not shown) for removal of spent steam from the bank 64. Each bank may be suspended within the chamber 22 by securement to the lower section 20 adjacent the steam inlets 74 and the condensate outlet 78.

The power drive 18 includes an electric motor 80 operably couple to a gear reducer 82 by a power train 84 which in turn is drivingly coupled with the shaft 34 via a chain and sprocket assembly 86. In preferred forms, the power drive 18 rotates the rotor 16 at a relatively slow speed in the neighborhood of 25 rpm.

In order to control outflow of product through the outlet 28, there is provided an adjustable weir 88 to selectively vary the height of the outlet 28 with respect to the chamber 22.

INDUSTRIAL APPLICABILITY

The dryer 10 of the present invention is specifically designed for removing water from fatty animal material as in a rendering operation. As previously explained, it is important that the dryer 10 be capable of handling high volumes of material utilizing only a minimum of heat energy.

The design of the present invention provides for maximum heat transfer within the chamber 22 such that material residence time is greatly reduced thereby avoiding damage to the product from excessive heat. Moreover, the open grillwork construction of the vanes 38 and the banks 64 permits processed material to flow therethrough axially of the rotor 34 for substantially increased heat transfer efficiency during processing.

Additionally, the interaction of the rotor 16 with the stator 14 greatly enhances the heat transfer capability of the dryer 10. In this regard, the rotating vanes 38 passing through the material within the chamber 22 transfer heat thereto while at the same time gently agitating the material for improved heat transfer from the stationary heat exchange banks 64 of the stator 14. This movement is also enhanced by the acircular configuration of the vanes 38 which creates a pulsing of the processed material upon rotation of the rotor 16. At the same time the stator 14 precludes undesired mass rotation of the material within the chamber 22 when the rotor 16 is driven.

By virtue of the construction of the dryer 10 it is possible to operate on a substantially continuous basis, introducing material into the inlet 26 while simultaneously withdrawing material from the outlet 28 in accordance with the adjustment of the weir 88.

What I claim is:

1. A dryer for processing hydrous animal material in slurry form, said dryer comprising:

a hollow elongate vessel having an inlet and an outlet, and presenting an enclosed, material-receiving chamber;

a heat transfer rotor in said chamber, said rotor including a shaft rotatably mounted on said vessel for rotation about an axis extending generally longitudinally of the vessel and an axially extending series of spaced, annular heat exchange vanes secured to the shaft for rotation therewith;

a heat transfer stator secured to said vessel within said chamber in cooperable relation to said rotor, said stator including a series of spaced, stationary heat exchange banks interleaved with said series of heat exchange vanes on said rotor;

means for circulating heat transfer fluid through said vanes and said banks; and a drive for rotating said rotor whereby relative movement between said vanes and said banks is effected for enhanced heat transfer to material in the chamber.

2. The invention of claim 1, each of said vanes and banks comprising an open grillwork of tubular members.

3. The invention of claim 2, the grillwork of each said vane including multiple toroidal tubes concentrically arranged in a plane extending generally perpendicularly of said axis of said shaft.

4. The invention of claim 3, said toroidal tubes each being acircular axis whereby relative radial movement occurs between the tubes and tubular segments upon rotation of said shaft.

5. The invention of claim 3, said inlet and said outlet being disposed at opposite ends of said vessel, the spaces between the tubes of each said vane, and between the segments of each said bank, being substantially unobstructed to permit free flow of said material through said vanes and said banks longitudinally of the vessel from the inlet to the outlet.

6. The invention of claim 5, there being the same number of tubes in each vane and a corresponding number of segments in each bank.

7. The invention of claim 6, said segments being substantially U-shaped with a bight and a pair of opposed legs, the bight of each segment having substantially the same diameter as a correspondingly positioned toroidal tube.

8. The invention of claim 5, said banks and said vanes being disposed in parallel planes.

9. The invention of claim 8, said parallel planes extending substantially perpendicularly of said shaft.

10. The invention of claim 3, said tubes and said tubular segments having identical, circular transverse cross-sections.

11. The invention of claim 3, the grillwork of each bank comprising a number of complemental curvilinear tubular segments concentrically and coplanarly disposed about a common axis extending longitudinally of the vessel in radially spaced relation to one another.

* * * * *